United States Patent [19]

Paret

[11] 4,190,145

[45] Feb. 26, 1980

[54] CIGARETTE DISPENSING APPARATUS

[76] Inventor: Dana C. Paret, East Shore Dr., Silver Lake, N.H. 03875

[21] Appl. No.: 944,789

[22] Filed: Sep. 22, 1978

[51] Int. Cl.[2] ..... G07F 11/04

[52] U.S. Cl. ..... 194/1 P

[58] Field of Search ..... 194/37, 94, 1 P; 221/266, 143, 147, 136

[56] References Cited

U.S. PATENT DOCUMENTS

| | | | |
|---|---|---|---|
| 1,114,159 | 10/1914 | Luedtke | 221/266 X |
| 1,481,739 | 1/1924 | Polhamus et al. | 194/48 |
| 1,644,134 | 10/1927 | Kelley | 194/48 X |
| 1,715,104 | 5/1929 | Simpson | 194/48 |
| 2,261,654 | 11/1941 | Livengood | 221/266 X |
| 2,565,183 | 8/1951 | Morgan | 221/266 |
| 2,587,225 | 2/1952 | Rossi | 221/266 X |
| 3,144,113 | 8/1964 | Peterson | 194/37 |
| 3,690,430 | 9/1972 | Moreland | 194/94 |

*Primary Examiner*—Stanley H. Tollberg

*Attorney, Agent, or Firm*—Stephen A. Gratton; Jack E. Ebel

[57] ABSTRACT

A coin operated dispensing apparatus for vending cylindrical items such as individually packaged cigarettes. Generally stated the dispensing apparatus comprises a vertically mounted storage magazine for storing a plurality of cylindrical items to be dispensed, a dispensing gate rotatably mounted across an outlet opening of the magazine for retaining or discharging the cylindrical items from the magazine, and a weighted balance beam coupled through a linkage to the dispensing gate for operating the gate. The balance beam is normally positioned by a counterweight to hold the dispensing gate in an outlet blocking position in which all the cylindrical items are retained in the magazine. In operation the balance beam can be shifted by the weight of a coin for rotating the dispensing gate from the outlet blocking position to a discharge position in which a single item is allowed to drop through the outlet opening of the magazine for dispensing the item.

9 Claims, 9 Drawing Figures

CIGARETTE DISPENSING APPARATUS

FIELD OF THE INVENTION

This invention relates to automatic vending and dispensing apparatus and more particularly to a novel coin operated dispensing apparatus especially adapted for dispensing cylindrical items such as individually packaged cigarettes or the like.

BACKGROUND AND SUMMARY OF THE INVENTION

Various coin operated vending and dispensing apparatus are well known in the prior art. Generally these dispensing apparatus are coin operated to dispense packaged items such as candy or cigarettes. In the case of cigarette vending machines, the cigarettes are generally packaged and dispensed in multiple units such as packages of twenty. In the past, due to the costs involved in operating a vending machine and the low costs of a single cigarette, it has generally not been economically or commercially practical to dispense items such as cigarettes in individually packaged units. Because of today's increased costs for cigarettes and many other items however, it has now become economically practical to operate vending apparatus for dispensing individually packaged units of an item.

The present invention is directed to a coin operated dispensing apparatus capable of dispensing cylindrical items such as individually packaged cigarettes. Generally stated the dispensing apparatus of the invention comprises a vertically mounted storage magazine for storing a plurality of cylindrical items to be dispensed, a dispensing gate rotatably mounted across an outlet opening of the magazine for retaining or discharging the items from the magazine, and a coin operated weighted balance beam coupled through a linkage to the dispensing gate for operating the gate. The balance beam is normally positioned by a counterweight to hold the dispensing gate in an outlet blocking position in which the items are retained in the magazine. In operation the balance beam can be shifted by the weight of a coin for rotating the dispensing gate from the outlet blocking position to a discharge position in which a single item is allowed to drop through the outlet opening of the magazine for dispensing.

Other objects, advantages, and capabilities of the present invention will become more apparent when taken in combination with the following drawing in which similar reference numerals represent similar parts and in which:

FIG. 1 is a front elevation view of an individually packaged cigarette dispenser constructed in accordance with the invention;

FIG. 1*a* is a partial front elevation view of the cigarette dispenser showing the gate in a discharge position;

FIG. 2 is a side elevation view of FIG. 1;

FIG. 2*a* is a partial side elevation of FIG. 1*a*;

DETAILED DESCRIPTION OF THE INVENTION

Figure 1:
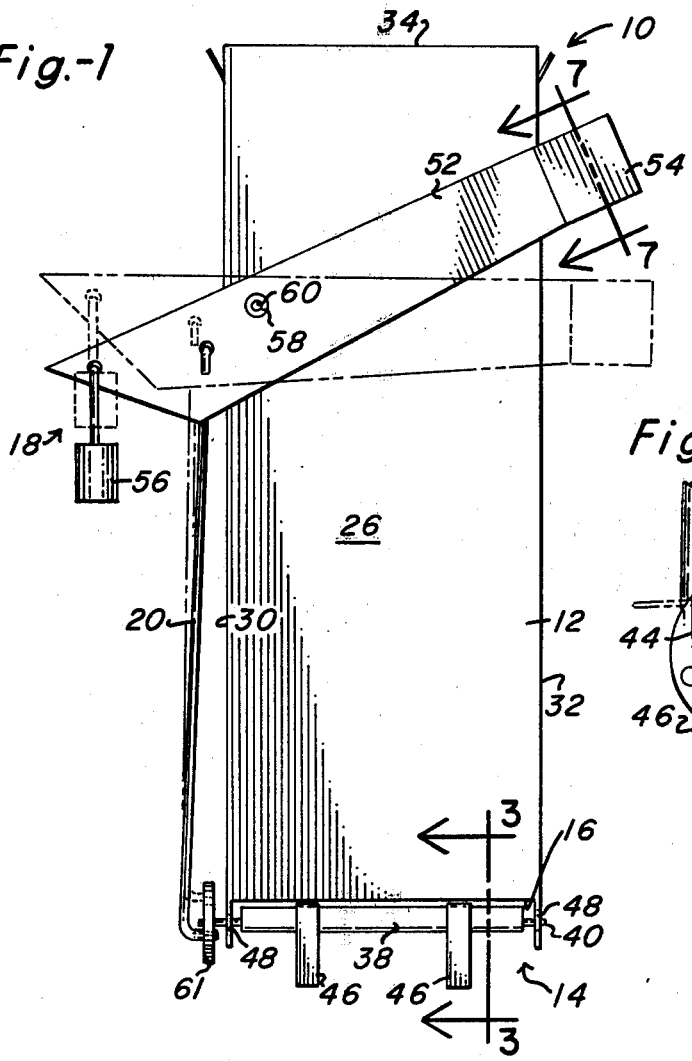

Referring now to FIG. 1 the dispensing apparatus 10 of the invention is shown and generally stated comprises, a vertically mounted storage magazine 12 for storing a plurality of cylindrical items to be dispensed, a dispensing gate assembly 14 for directing the cylindrical items from an outlet opening 16 of the storage magazine 12 one at a time, and a weighted balance beam assembly 18 coupled through a linkage 20 to the dispensing gate assembly 14 for operating the dispensing gate.

Figure 5:
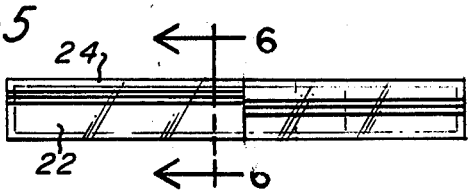
FIG. 5 is a side elevation view of a packaged cigarette for use in the dispenser of the invention.
Figure 6:
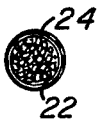
FIG. 6 is a cross sectional view along section line 6—6 of FIG. 5.

In the illustrative embodiment of the invention the dispensing apparatus 10 is constructed for dispensing individually packaged cigarettes 22. As shown in FIGS. 5 and 6 each cigarette 22 is packaged in a two piece cylindrical plastic capsule 24. Each capsule 24 has an inside diameter sized to fit snugly around the outside diameter of the cigarette 22. Once dispensed however, the capsule 24 can be easily removed from the cigarette 22 by separating its two halves. The outside surface of the capsule 24 may be printed with a trademark or other information such as the Surgeon General's warning. Although the invention is described as a dispenser for individually packaged cigarettes it is to be understood that the dispensing apparatus 10 of the invention is equally suitable for dispensing other cylindrical items.

As shown in FIG. 1 the storage magazine 12 of the dispensing apparatus 10 has a generally rectangular outer peripheral configuration and a generally rectangular cross sectional configuration with two parallel spaced sidewalls 26, 28 and two parallel spaced endwalls 30, 32. The storage magazine 12 may be formed from a material such as sheet metal and is constructed with cross sectional length and width dimensions that allow the individually packaged cigarettes 22 to be retained within the magazine but to roll easily within the magazine under the force of gravity. The magazine 12 is provided with an outlet opening 16 and an inlet opening 34 for the packaged cigarettes 22. In operation the magazine is mounted in an approximately vertical position as shown in FIG. 1 with the inlet opening 16 located higher than the outlet opening 34 so that the packaged cigarettes 22 may roll by gravity from the inlet 34 to the outlet 16. The endwalls 30, 32 of the magazine adjacent to the inlet opening 34 are bent outwardly from one another for allowing the cigarettes to be more easily inserted into the inlet opening 34 of the magazine. In addition the magazine 12 is provided with a plurality of through apertures 36 (FIG. 2) along endwall 26 to provide additional inlets for loading the magazine 12 with packaged cigarettes 22.

For mounting the dispensing gate assembly 14 to the storage magazine 12 the endwalls 30 and 32 of the magazine are extended past the sidewalls 26 and 28 at the outlet opening 16. As will hereinafter be explained this allows the gate assembly to be rotatably mounted over the outlet opening 16 and positioned for retaining the cigarettes within the magazine or for discharging a single cigarette from the outlet.

Figure 2:
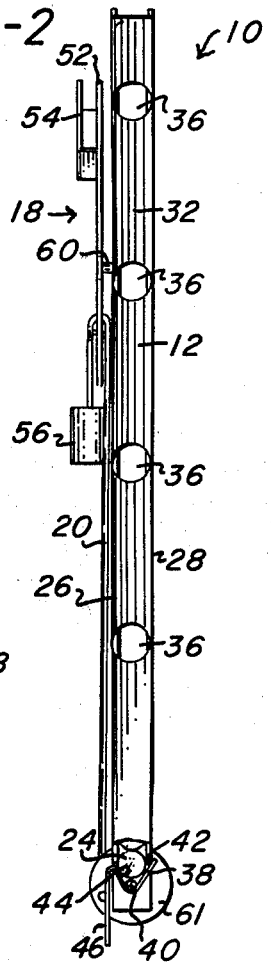
Figure 3:
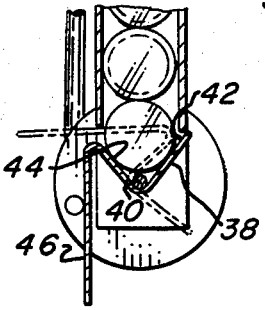
FIG. 3 is an enlarged sectional view along section line 3—3 of FIG. 1 showing a portion of the gate assembly.
Figure 1A:
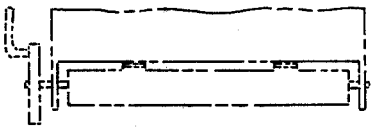

The dispensing gate assembly 14 of the dispensing apparatus 10 generally stated comprises a generally L-shaped gate 38 pivotally mounted on a shaft 40 to the end walls 30 and 32 of the magazine. The gate 38 is shiftable from an outlet blocking position shown in solid lines in FIGS. 1 and 2 to a discharge position shown in fathom in FIGS. 1*a* and 2*a* in which a single cigarette is allowed to drop through the outlet 16 of the magazine. As shown in FIG. 3 the gate 38 has a first side portion 42 and a second side portion 44 formed at approximately right angles to one another and a pair of parallel spaced retaining ears 46 formed integrally with and at an acute angle to side portion 44 of the gate. As shown in FIG. 2 the side portions 42 and 44 of the gate are dimensioned to retain a single packaged cigarette 22 therebetween. Side portion 42 is dimensionally wider than side portion 44 however, and acts as a stop in the blocking position of the gate 38 (FIG. 2) by abutting sidewall 28 of the storage magazine 12 and preventing further rotation of the gate 38. The mounting shaft 40 for the gate 38 extends across the line of intersection of the two side portions 42 and 44 and may be permanently attached to the gate by welding or soldering. The ends of the mounting shaft are journalled to two bushings 48 attached to the endwalls 30, 32 of the magazine.

Figure 2A:
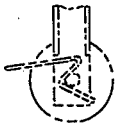

With this mounting arrangement the gate 38 is pivotable to either of the two positions shown in FIG. 2 and 2*a*. In the blocking position shown by solid lines in FIG. 2 side portions 42 and 44 of the gate 38 block the outlet opening and retain a single cigarette 22 within the gate. In the discharge position shown in fathom in FIG. 2 the gate 38 is positioned to allow the previously retained single cigarettes to roll across side portion 42 for discharge from the outlet opening 16. In addition in the discharge position the retaining ears 46 extend across the outlet opening 16 abutting the sidewalls 26 and 28 of the magazine to prevent the remaining cigarettes from falling through the outlet opening.

The balance beam assembly 18 for the dispensing apparatus 10 generally comprises a balance beam 52 pivotally mounted to the outside of sidewall 26 of the magazine, an open ended coin receptacle 54 attached to one end of the balance beam 52, and a counterweight 56 suspended from an end of the balance beam 52 opposite to the coin receiving enclosure 54.

The balance beam 52 is a generally flat sheet of material with a generally rectangular peripheral configuration. The balance beam 52 has an off-center bushing 58 attached thereto which is journalled to a pivot pin 60 attached to sidewall 26 of the magazine. Pivot pin 60 is attached to sidewall 26 approximately perpendicular to the plane of the sidewall 26. With this arrangement the balance beam 52 is rotatable to the positions shown in FIG. 1 for positioning the gate 38 in its blocking or discharge position.

Figure 4:
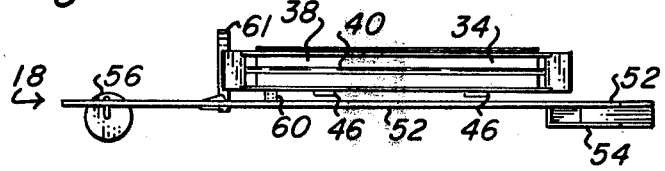
FIG. 4 is a plan view of FIG. 1.
Figure 7:
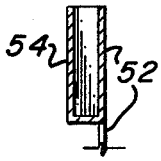
FIG. 7 is a cross sectional view along section line 7—7 of FIG. 1.

As shown in FIG. 7 the coin receptable 54 is generally u-shaped and is attached to one end of the balance beam 52. The coin receptacle 54 is open on two sides to allow a coin to be dropped from above into the receptacle 54 and then to roll out of the receptacle 54 past the end of the balance beam 52 into a coin box (not shown) or the like for storing the coins. When a coin is dropped into the coin receptacle 54 the balance beam is rotated by the weight of the coin to the fathom position shown in FIG. 1 until the coin rolls out the open end of the coin receptacle 54 into the coin box. The counterweight 56 then rotates and balances the balance beam 52 back to the position shown by solid lines. In the form of the invention shown the counterweight 56 is sized and positioned such that a dime dropped into the coin receptacle will shift the balance beam.

The balance beam 52 is pivotally coupled to the linkage 20 which in turn is pivotally coupled to a circular link plate 61 attached to the mounting shaft 40 of the gate assembly 14. Rotation of the balance beam by a coin from its at rest position shown by solid lines in FIG. 1 to its shifted position shown in fathom rotates the gate 38 from the blocking position shown by solid lines in FIG. 2 to the discharge position shown in fathom in FIG. 2*a* for discharging a single cigarette 22 from the outlet opening 16 of the magazine 12.

The entire dispenser apparatus 10 may be mounted in an enclosed cabinet or the like (not shown) which may be provided with a coin guide chute for guiding coins into the coin receptacle 54 on the balance beam and a coin box for receiving coins after they roll from the coin receptacle 54. If dimes are utilized as the operable coin the cabinet may be provided with a coin inlet slot and a coin guide chute sized to allow only dimes to be inserted.

In operation the magazine 12 is first loaded with a quantity of packaged cigarettes 22 which are stacked in the magazine in a single row. The balance beam 52 is normally positioned by the counterweight 56 at an incline with the coin receptacle 54 above the counterweight 56. In its at rest position the balance beam 52 holds the gate 38 in its outlet blocking position with a single cigarette retained between side portions 42 and 44 of the gate 38. When a coin is dropped through the coin guide chute into the coin receptacle 54 on the balance beam 52 the beam is tilted by the weight of the coin and the gate 38 is shifted to its discharge position allowing the single previously retained cigarette 22 to drop through the outlet opening 16 of the magazine. While in its discharge position the retaining ears 46 on the gate 38 abut the sidewalls 26 and 28 approximately perpendicular to the plane of the cigarettes and prevent the other cigarettes from dropping through the outlet opening. Once the balance beam 52 is shifted by the weight of the coin, the coin rolls out the open end of the can receptacle 54 into the coin box. When the coin has rolled out of the coin receptacle 54 the counterweight 56 returns the balance beam 52 to its original at rest position with the gate assembly 14 in its blocking position.

While the presently preferred embodiment of the invention involves a dispenser for individually packaged cigarettes, it is contemplated that certain of the inventive concepts may be advantageously utilized with dispensers for other items. Thus it is intended that alternate embodiments and modifications of the inventive concepts be included within the scope of the appended claims, except insofar as limited by the prior art.

What is claimed is:

1. Vending apparatus for dispensing cylindrical items one at a time comprising:

an elongated storage magazine for storing a plurality of cylindrical items to be dispensed and having an inlet opening for receiving the items and an outlet opening below the inlet for discharging the items;

a generally L-shaped dispensing gate rotatably mounted to the storage magazine across the outlet opening thereof and shiftable from a first blocking position in which the cylindrical items are retained in the storage magazine to a second dispensing position in which a single item is allowed to drop through the outlet opening; and a balance beam rotatably mounted to the storage magazine and having a counterweight attached to one end and a generally u-shaped coin receptacle at the opposite end open on a top side for receiving a coin and on an end side for allowing a coin to roll out of the receptacle with said balance beam coupled through a linkage to the dispensing gate such that the counterweight normally positions the balance beam for maintaining the gate in a blocking position but deposit of a coin into the coin receptacle tilts the balance beam and shifts the dispensing gate to the discharge position.

2. Vending apparatus as defined in claim 1 and wherein the storage magazine has a plurality of inlet openings for receiving the items to be dispensed.

3. Vending apparatus as defined in claim 1 and wherein the dispensing gate is formed with two spaced retaining ears attached to one side for preventing items in the storage magazine from rolling through the outlet opening while the dispensing gate is in the discharge position.

4. Vending apparatus as defined in claim 1 and wherein the cylindrical items are individually packaged cigarettes.

5. Vending apparatus for dispensing individually packaged cigarettes comprising:

an elongated storage magazine sized to retain a plurality of stacked cigarettes and having an inlet opening for receiving the cigarettes and an outlet opening located below the inlet opening for discharging the cigarettes by force of gravity;

a generally L-shaped dispensing gate rotatably mounted on a mounting shaft over the outlet opening and rotatable from a blocking position in which the outlet is blocked to a discharge position in which one cigarette is allowed to drop from the outlet opening;

a balance beam rotatably mounted to the magazine and coupled through a linkage to the dispensing gate for rotating the dispensing gate;

a counterweight at one end of the balance beam; and a generally u-shaped coin receptacle attached to one end of the balance beam and having an open top side for receiving coins and an open end for allowing coins to roll out of the receptacle whereby a coin may be deposited into the coin receptacle to rotate the balance beam and shift the gate from a blocking position to a discharge position and thence roll out of the coin receptacle such that the counterweight rotates the balance beam to shift the dispensing gate back to a blocking position.

6. The vending apparatus as defined in claim 5 and wherein the storage magazine has a generally rectangular cross sectional configuration.

7. The vending apparatus as defined in claim 6 and wherein the cigarettes are packaged in plastic capsules.

8. The vending apparatus as defined in claim 7 and wherein the storage magazine has a plurality of inlet openings along one side for admitting packaged cigarettes into the storage magazine.

9. The vending apparatus as defined in claim 8 and wherein the dispensing gate has a pair of retaining ears attached to one side for retaining the stack of cigarettes while the dispensing gate is in the discharge position.

* * * * *